United States Patent [19]

Hwang

[11] Patent Number: 4,995,847

[45] Date of Patent: Feb. 26, 1991

[54] BALANCE TYPE MINUTE LENGTHENABLE ADJUSTER

[76] Inventor: Ying Teh Hwang, No. 220, Ruey Feng St., Kaohsiung, Taiwan

[21] Appl. No.: 424,737

[22] Filed: Oct. 20, 1989

[51] Int. Cl.[5] ..... A41C 3/00

[52] U.S. Cl. ..... 450/71; 450/58; 2/321; 2/322

[58] Field of Search ..... 450/71, 17, 18, 63, 450/86, 58; 2/73, 311, 312, 317, 319, 321, 322, 338; 24/182, 518, 543

[56] References Cited

U.S. PATENT DOCUMENTS

| | | | |
|---|---|---|---|
| 1,414,048 | 4/1922 | Schlutz | 24/518 |
| 1,424,103 | 7/1922 | Johnson | 24/518 |
| 2,775,013 | 12/1956 | Pedero | 24/518 |
| 3,034,189 | 5/1962 | Twentier | 2/322 |
| 3,038,166 | 6/1962 | Tobias | 2/321 |
| 3,302,649 | 2/1967 | Bruno | 450/63 |

FOREIGN PATENT DOCUMENTS

| | | | |
|---|---|---|---|
| 1107388 | 12/1955 | France | 450/71 |
| 0175799 | 1/1953 | Nauru | 2/321 |

*Primary Examiner*—William H. Cuchlinski, Jr.
*Assistant Examiner*—Daniel G. DePumpo
*Attorney, Agent, or Firm*—Bacon & Thomas

[57] ABSTRACT

A balance type minute lengthenable adjuster able to be applied to caps, breast cups, etc., comprising an adjusting band, a buckle, a band pincher, two rings and two bands. One end of the adjusting band is tied with the buckle and then goes orderly through the right ring, the left ring, the band pincher, the buckle, and finally the band pincher once again. The adjusting band is pinched immovable between a positioning flap and a short tube of the band pincher. The positioned flap is able to be pivotally turned up or down to pinch immovable the adjusting band between itself and the short tube after the length of the adjusting band has been adjusted between the two rings.

5 Claims, 4 Drawing Sheets

BALANCE TYPE MINUTE LENGTHENABLE ADJUSTER

BACKGROUND OF THE INVENTION

Many kinds of adjusters are seen in a lot of common things in our daily life, such as those used in caps to adjust the length of the circumferential edges to fit on heads and those used for tightening properly breast cups to wear them.

Take length adjusters for breast cups as an example. Female breasts may change their size because of various causes such as exercise, physiological phenomenons, etc., and therefore, the length of the band for breast cups has to be adjusted according to the alteration of the feminine breast size so that the tightness of the breast band can be kept best suitable for her body without giving an oppressive feeling. It is just the same as a button released for a tight shirt worn on a person's body can give a comfortable feeling to the wearer.

As to the traditional length adjuster for feminine breast cup band, it is usually located at the back, having two sections as shown in FIG. 1, wherein are provided cups 40, a first band 41, a hook 411 at the free end of the first band 41, a second band 42, two pairs of two hook connectors 421, 422 at the free end of the second band 42. When the hooks 411 hook at the hook connectors 42!, the breast band is longer or slack, and when the hooks 41 hook at the hook connectors 422, the breast band is shorter or tight. But this kind of adjuster is not effective, having drawbacks listed below.

1. It is not convenient for hooking, from the view point of human structure, as it is located at the back, quite difficult to handle it, as it cannot be seen.

2. In adjusting the length of the breast band, only the first band 41 is advanced by replacing the hook 411 from the hook connector 421 to that 422, and the band 42 does not move at all. Consequently the length of the cup band is adjusted only for one side, not balancedly for two sides.

3. As it can only be adjusted into two kinds of length, it can hardly be applied to many alterations as the balance type minute lengthenable adjuster in this invention can.

Another kind of traditional breast cups, as shown in FIG. 2, has a hook connector 51 at the front between the two cups, which is convenient to handle, but it has no length adjuster for tightening the cup band.

SUMMARY OF THE INVENTION

In view of the disadvantages of traditional length adjusters used for cup bands tying breast cups, this invention has been devised to improve them, furnishing a balance type minute lengthenable adjuster having the function to be unlimitedly and minutely adjusted in length and to move both side cup bands at the same time to attain a balanced adjustment.

The balance type minute lengthenable adjuster in accordance with the present invention comprises a band pincher, a buckle, two rings, an adjusting band and two bands.

The adjusting band has its right end tied with a ring in the buckle, and then passes through the right side ring, with which the right band is tied. Then the adjusting band bends around and extends leftward, passing orderly through the left ring, a short tube comprised in the band pincher, then the other ring in the buckle and is finally pinched between a positioning flap and the short tube of the band pincher; thus the adjusting band is kept immovable.

The band pincher comprises a short tube of a nearly rectangular cross-section for the adjusting band to go through and a positioning flap pivotally connected with the short tube and able to be turned up or down for pinching the adjusting band immovable between itself and the outer surface of the short tube. If the positioning flap is turned up, the length of adjusting band, being released, can be adjusted between the left and the right ring by pulling the adjusting band. When the adjusting band is properly adjusted in length, the positioning flap can be turned down to stick with the short tube by means of a protruding edge and a hooking edge, and thereby the adjusting band is pinched therebetween immovable.

DETAILED DESCRIPTION OF THE INVENTION

Figure 3:
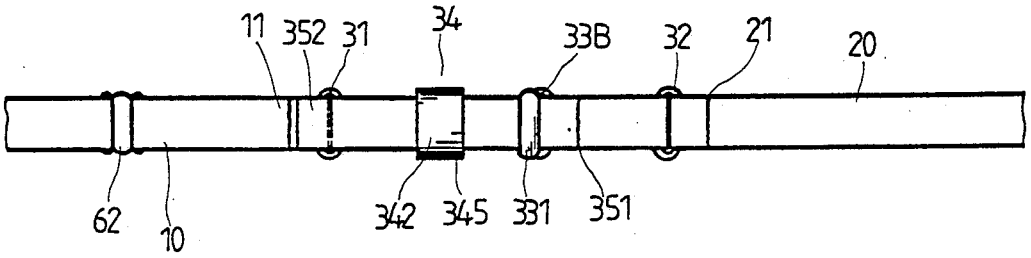
FIG. 3 is a front view of the balance type minute lengthenable adjuster in accordance with the present invention.
Figure 4:
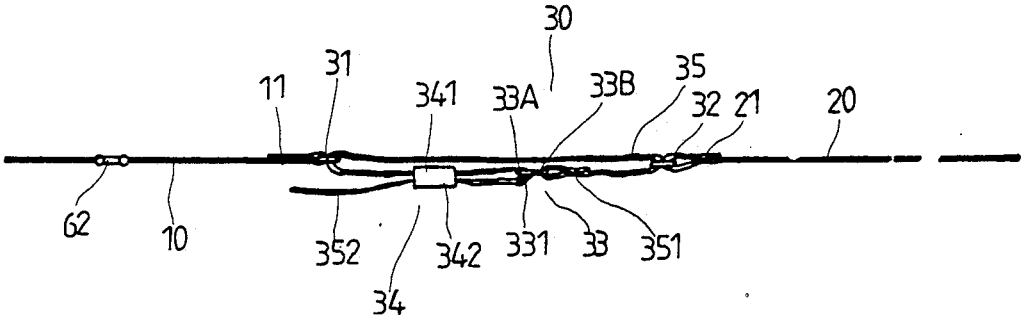
FIG. 4 is an upside view of the balance type minute lengthenable adjuster in accordance with the present invention.
Figure 6:
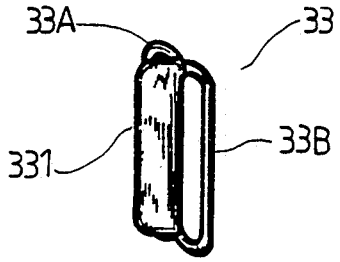
FIG. 6 is a perspective view of the buckle in the balance type minute lengthenable adjuster in accordance with the present invention.

The balance type minute lengthenable adjuster 30 comprises, as shown in FIG. 3 and 4, a left ring 31 and a right ring 32 for tying bands 10 and 20 respectively, a buckle 33, a band pincher 34 and an adjusting band 35. The left ring 31 is tied with the end 11 of the left band 10, and so is the right ring 32 with the end 21 of the right band 20. The buckle 33 is provided with a ring 33A and a ring 33B abutting on each other, and a pushing chip 331 as shown in FIG. 6. The ring 33B is for the end 351 of the adjusting band 35 to go through to be tied together with the band body so that the both 33B and 35 are connected together. Then the other end 352 of the adjusting band 35 goes orderly through the ring 32, the ring 31, the band pincher 34, the ring 33A and finally the band pincher 34 once again.

Figure 7:
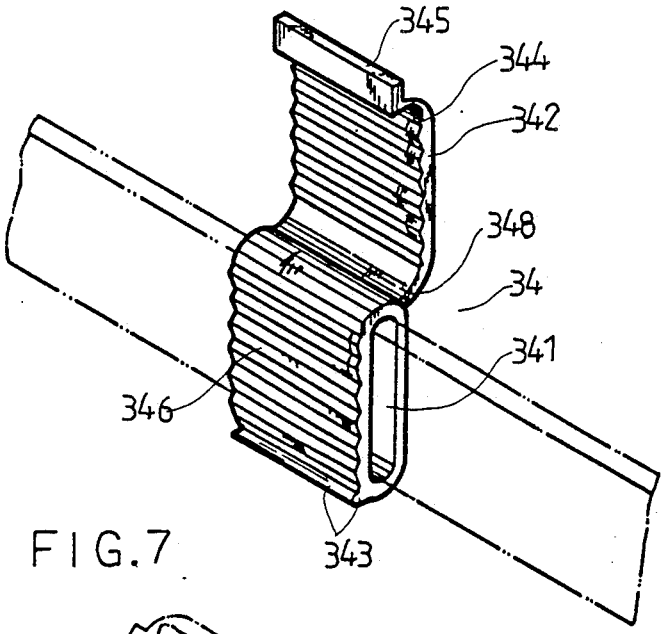
FIG. 7 is a perspective view of the positioning flap in the balance type minute lengthenable adjuster in accordance with the present invention.
Figure 8:
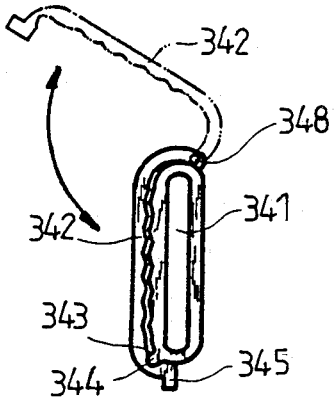
FIG. 8 is a side view of the positioning flap closed in the balance type minute lengthenable adjuster in accordance with the present invention.

The band pincher 34 has a structure shown in FIG. 7, comprising a short tube 341 of a nearly rectangular cross-section for the adjusting band 35 to go through its inner hollow, a positioning flap 342 pivotally connected at the outer top edge of the short tube 341 and having the same roughened (as zigzag) surface 347 as the vertical outer roughened surface 346 of the short tube 341. The positioning flap 342 is provided with a hooking edge 344 and a pulling edge 345 abutting on each other at the free end. The positioning flap 342 can be pivotally turned up and down with an axial pin 348 as shown in FIG. 8, and when said flap 342 is turned down, the hooking edge 344 overpasses a protruding edge 343 at the bottom of the short tube 341, stuck by the protruding edge 343, and both the roughened surfaces 346 and 347 can come to face against each other so as to pinch the body of the adjusting band 35. If the band 35 pinched therebetween is needed to be released, turning the positioning flap 342 upward by pushing the pulling edge 345 off the protruding edge 343 can effect the purpose.

Figure 5:
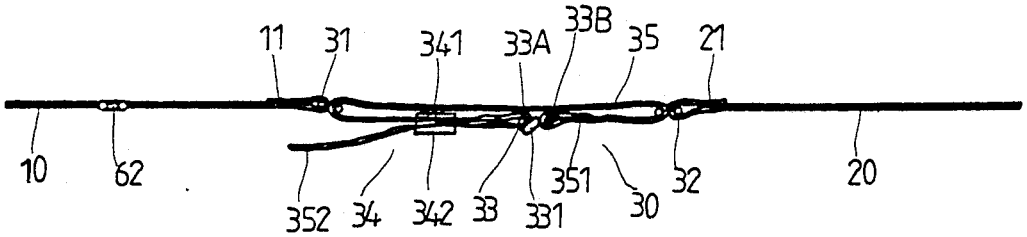
FIG. 5 is a cross-sectional view of the balance type minute lengthenable adjuster in accordance with the present invention.

The adjusting band 35 has to go through the short tube 341 at first after passing through the ring 31, as FIGS. 4 and 5 show, and then extends to pass through the ring 33A in the buckle 33 and forced by the pushing chip 331 to bend around and finally to be pinched between the positioning flap 342 and the short tube 341 so that the band 35 may be kept immovable with the end 352 extending from between the positioning flap 342 and the short tube 341.

Figure 9:
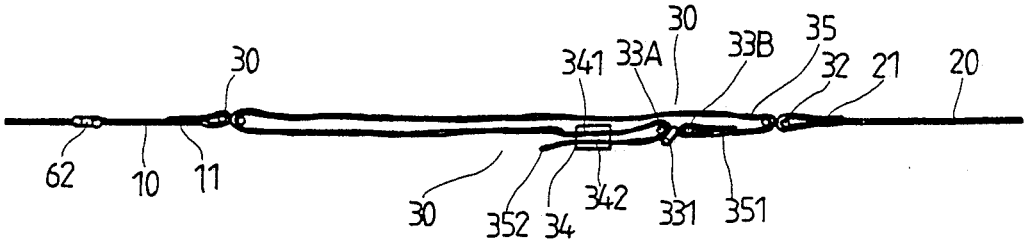
FIG. 9 is a cross-sectional view of the balance type minute lengthenable adjuster adjusted in a prolonged position.
Figure 10:
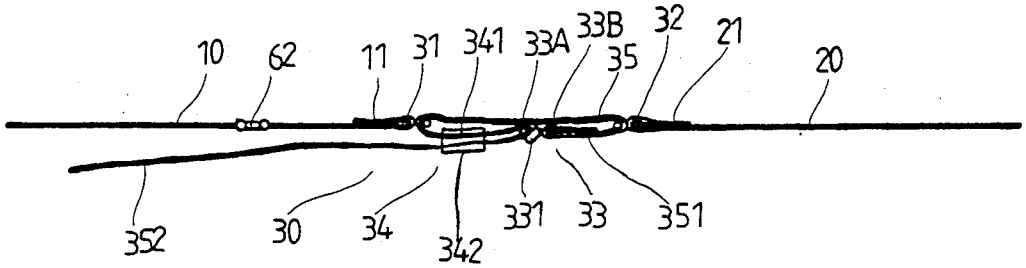
FIG. 10 is a cross-sectional view of the balance type minute lengthenable adjuster adjusted in a shortened position.

As can be understood from the above description, the adjusting band 35 is easily to be adjusted in its length between the ring 31 and the ring 32 by snapping off the positioning flap 342 to release the band 35 from being pinched therebetween, and then pulling the band 35 at the rings 31 and 32 lengthening its length between the rings 31 and 32 as shown in FIG. 9, to become longer than the length of the band 35 shown in FIG. 5. Then turning down the positioning flap 342 can pinch the band 35 between itself and the short tube 341 for stabilizing it. On the contrary, if the band 35 is needed to be shortened, the same actions are repeated as mentioned above, but the band 35 between the rings 31 and 32 should be pulled to become shorter as shown in FIG. 10 than that shown in FIG. 5.

Figure 1:
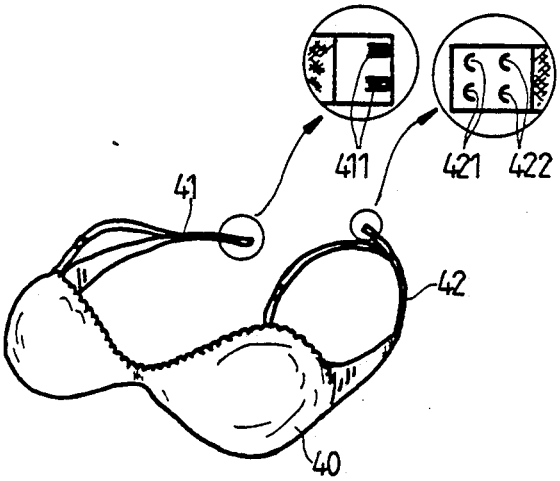
FIG. 1 PRIOR ART
FIG. 1 is a perspective view of a first kind of traditional breast cups tied with bands.
Figure 2:
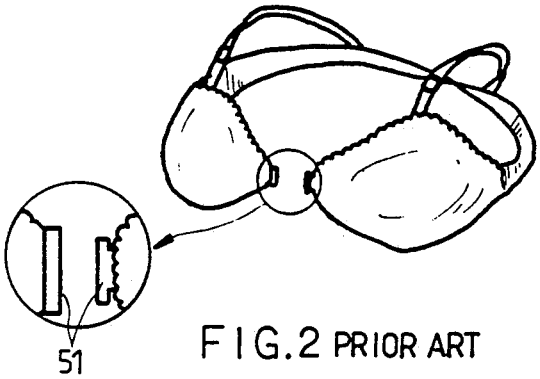
FIG. 2 PRIOR ART
FIG. 2 is a perspective view of a second kind of traditional breast cups tied with bands.
Figure 11:
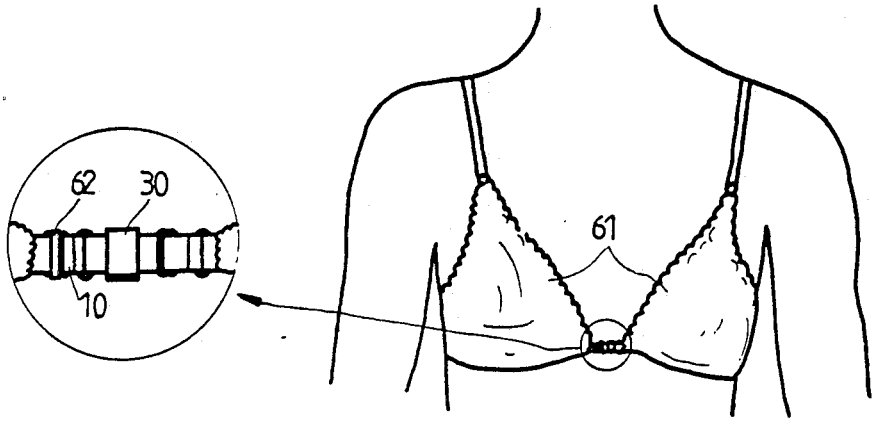
FIG. 11 is a front view of the balance type minute lengthenable adjuster applied to breast cups worn on a human body.

In order to apply this balance type minute lengthenable adjuster 30 to breast cups 61, a hook connector 62 such as shown in FIG. 11 is provided between the breast cups 61 and the left band 10 or the right band 20 so that the left or the right cup 61 can be connected with the minute lengthenable adjuster 30 joined with the right or the left cup. Then the balance type minute lengthenable adjuster 30 can be manipulated to tighten or loosen the band 35 on both sides for any length to suit it on a human body.

In general, this invention can not only be applied to breast cups, but also to caps, etc., to any thing wherein the length needs to be adjusted.

What is claimed is:

1. A balance type minute lengthenable adjuster comprising:

(a) a left band ring and a right band ring;

(b) a left band and a right band, each band including a terminal end connected, respectively, to the left band ring and the right band ring;

(c) a continuous adjusting band passing through the left and right band rings, the band including a left end portion and a right end portion;

(d) a band pincher including a short tube having a substantially rectangular cross section for receiving the adjusting band therethrough and a positioning flap pivotally connected to a top edge of the short tube for pinching the adjusting band between the flap and an outer surface of the short tube;

(e) a buckle including a left buckle ring and a right buckle ring, the left buckle ring having a pushing chip at a side thereof, the left end portion of the adjusting band being passed through the short tube and the left buckle ring and folded back onto itself and pinched between the positioning flap and the outer surface of the short tube, and the right buckle ring being secured to the right end portion of the adjusting band; and (f) whereby when the positioning flap is released from the left end portion of the adjusting band, the latter may either be pulled out through the left buckle ring to shorten the distance between the left and right band rings or released back through the left buckle ring to increase the distance between the left and right band rings, and thereafter secured in a desired position of adjustment by pitching the left end portion between the positioning flap and outer surface of the short tube.

2. The adjuster of claim 1 wherein the short tube includes a protruding edge at a bottom thereof, the positioning flap includes a hooking edge, and the hooking edge being detachably engageable with the protruding edge for securing the adjusting band in a pinched position.

3. The adjuster of claim 2 wherein the positioning flap further includes a pulling edge positioned adjacent the hooking edge and extending downwardly therefrom when the hooking edge is in engagement with the protruding edge.

4. The adjuster of claim 1 wherein the outer surface of the short tube is roughened for frictionally engaging the adjusting band pinched thereagainst.

5. The adjuster of claim 1 wherein the positioning flap includes a roughened inner surface for frictionally engaging the adjusting band pinched thereagainst.

* * * * *